US012252226B2

(12) United States Patent
Bakstad

(10) Patent No.: US 12,252,226 B2
(45) Date of Patent: Mar. 18, 2025

(54) MARINE VESSEL PROPULSION APPARATUS

(71) Applicant: Darren James Bakstad, Lake Country (CA)

(72) Inventor: Darren James Bakstad, Lake Country (CA)

( * ) Notice: Subject to any disclaimer, the term of this patent is extended or adjusted under 35 U.S.C. 154(b) by 462 days.

(21) Appl. No.: 17/656,455

(22) Filed: Mar. 25, 2022

(65) Prior Publication Data

US 2023/0303227 A1 Sep. 28, 2023

(51) Int. Cl.
*B63H 20/00* (2006.01)
*B63H 23/34* (2006.01)

(52) U.S. Cl.
CPC ..... *B63H 20/007* (2013.01); *B63H 23/34* (2013.01)

(58) Field of Classification Search
CPC ..... B63H 20/00; B63H 20/007; B63H 20/08; B63H 20/12; B63H 20/14; B63H 20/20; B63H 23/00; B63H 23/32; B63H 23/34; B63H 23/342; B63H 25/00; B63H 25/42
USPC ..... 440/6, 49, 53, 75, 79, 81, 83, 84, 86
See application file for complete search history.

(56) References Cited

U.S. PATENT DOCUMENTS

2011/0223816 A1* 9/2011 Boukas ..... B63H 1/14 440/6
2015/0047548 A1* 2/2015 Mazin ..... B63C 11/46 114/315
2024/0116620 A1* 4/2024 Nogle ..... B63H 25/42

FOREIGN PATENT DOCUMENTS

AU 2003200216 A1 * 8/2003 ..... B63H 21/12

* cited by examiner

*Primary Examiner* — Daniel V Venne
(74) *Attorney, Agent, or Firm* — Orin Del Vecchio

(57) ABSTRACT

A marine vessel propulsion apparatus that is configured to handheld by a user and employed to either propel a small marine craft or assist in the maneuvering of a larger marine vessel. The present invention includes a motor assembly having a waterproof housing with a power supply operably coupled thereto. The motor assembly is operably coupled to a shaft assembly wherein the shaft assembly includes a shaft and a propeller secured thereto. The shaft is releasably secured to the motor assembly and is manufactured from a non-conductive lightweight material. The shaft is configured to rotate in both a clockwise or counterclockwise direction. The shaft further can include a float member secured thereto wherein the float member is manufactured from a buoyant material. The propeller can be provided in alternate diameters and have alternate quantities of blades.

8 Claims, 2 Drawing Sheets

MARINE VESSEL PROPULSION APPARATUS

FIELD OF THE INVENTION

The present invention relates generally to marine equipment, more specifically but not by way of limitation, a portable marine vessel propulsion apparatus that can be used to assist in maneuvering of marine vessels or provide temporary propulsion thereof.

BACKGROUND

Boating is very popular in North America with approximately fifteen million boats of various types registered in the United States and Canada. There are numerous types of boats that are owned and utilized for various purposes by individuals. These boats can include but are not limited to fishing vessels, sailing vessels, day cruisers and watercraft sports vessels. Many boats can also be dual purpose wherein the owner can utilize the boat for various different marine activities. There are several types of propulsion for power boats with the three main types being an outboard motor, an inboard/outboard motor and an inboard. Depending upon the type of vessel and the intended purpose usually dictates a preferred power configuration.

One type of boat that is popular are wake surf boats. These boats are specifically designed for the sport of wake surfing. Wake surfing boats utilize inboard propulsion systems that include a fixed propeller and shaft with a rudder aft of the propeller that is utilized to steer the boat. This type of propulsion is needed for safety of the wake surfer as other types of propulsion place the propeller in a dangerous location for the wake surfer. While these inboard propulsion systems perform well, the handling of these boats is less nimble. As a result, tight quarters in marinas, windy conditions and other parameters can make it difficult to handle these types of boats. Additionally, small boats such as but not limited kayaks and canoes do not have propulsions systems. There are on occasions where operators of these types of boats could benefit from employing a portable marine propulsion apparatus to help either maneuver a boat or provide propulsion thereof.

Accordingly, there is a need for a portable marine propulsion system that can be utilized on various types of marine vessels to provide either maneuvering assistance or complete propulsion thereof.

SUMMARY OF THE INVENTION

It is the object of the present invention to provide a portable marine vessel propulsion system configured to be handheld by a user wherein the present invention includes a motor assembly.

Another object of the present invention is to provide a marine vessel propulsion apparatus operable to either maneuver or propel a vessel wherein the motor assembly includes a rechargeable power source such as but not limited to A further object of the present invention is to provide a portable marine vessel propulsion system configured to be handheld by a user that includes a propeller shaft wherein in a preferred embodiment of the shaft the shaft is manufactured from a non-conductive material.

Still another object of the present invention is to provide a marine vessel propulsion apparatus operable to either maneuver or propel a vessel that includes a propeller secured to the propeller shaft distal to the motor assembly.

An additional object of the present invention is to provide a portable marine vessel propulsion system configured to be handheld by a user wherein the propeller shaft can be configured to be buoyant either through material construction or having a float secured thereto.

Yet a further object of the present invention is to provide a marine vessel propulsion apparatus operable to either maneuver or propel a vessel wherein it is further contemplated within the scope of the present invention that the propeller could be configured to have a certain buoyancy.

Another object of the present invention is to a provide a portable marine vessel propulsion system configured to be handheld by a user wherein the motor assembly is configured to rotate the propeller in both a clockwise and a counterclockwise direction.

An alternate object of the present invention is to provide a marine vessel propulsion apparatus operable to either maneuver or propel a vessel wherein the marine vessel propulsion apparatus is lightweight and easy to carry.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
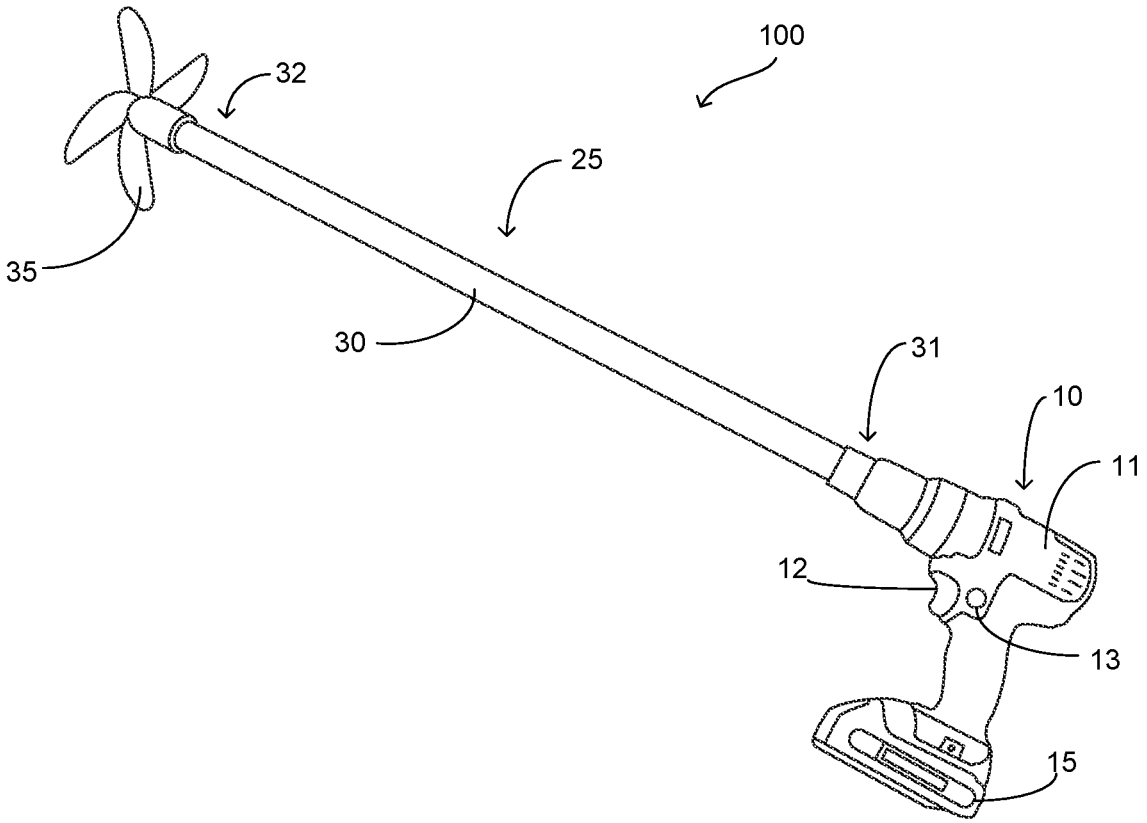
FIG. 1 is a perspective view of an embodiment of the present invention.

Referring now to the drawings submitted herewith, wherein various elements depicted therein are not necessarily drawn to scale and wherein through the views and figures like elements are referenced with identical reference numerals, there is illustrated a marine vessel propulsion apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the marine vessel propulsion apparatus 100 includes a motor assembly 10. The motor assembly 10 includes a housing 11 wherein the housing 11 is manufactured from a lightweight material such as but not limited to plastic. Disposed within the housing 11 is a conventional direct current electric motor. It should be understood within the scope of the present invention that the motor could be various outputs. The housing 11 is manufactured utilizing suitable techniques in order to produce a waterproof housing. While the housing 11 is illustrated herein as being a particular shape, it should be understood within the present invention that the housing 11 could be formed in various shapes and sizes. It is desired within the scope of the present invention that the housing 11 be formed in a shape and size that enables the housing 11 to be handheld. The housing 11 includes power button 12 wherein the power button 12 is operably coupled to the power supply 15. Engagement of the power button 12 provides rotational activation of the shaft assembly 25. Selector 13 is utilized to provide directional control of the rotation of the shaft assembly 25. Selector 13 provides directional control of the shaft 30 wherein the shaft 30 can be rotated in either a clockwise or counterclockwise direction. The power supply 15 is a conventional battery power supply such as but not limited to a lithium ion battery and is releasably secured to the housing 11 utilizing suitable techniques.

The shaft assembly 25 includes shaft 30 and having operably coupled thereto propeller 35. The shaft 30 is elongated and rod shape having end 31 formed to be releasably secured to housing 11. It should be understood within the scope of the present invention that the end 31 could be configured in numerous alternate embodiments so as to facilitate releasably coupling with the housing 11. It should be understood within the scope of the present invention that the shaft 30 could be provided in alternate lengths with a length of three feet being a preferred embodiment. While it is contemplated within the scope of the present invention that the shaft 30 could be manufactured from various lightweight rigid materials, in a preferred embodiment of the present invention the shaft 30 is manufactured from a non-conductive material such as but not limited to nylon.

Operably coupled to shaft 30 proximate end 32 is the propeller 35. The propeller 35 is a conventional marine propeller manufactured from a suitable durable lightweight material. The propeller 35 is secured employing conventional fasteners and it should be understood within the scope of the present invention that the propeller 35 could have alternate quantities of blades. Furthermore, it should be understood within the scope of the present invention that the propeller 35 could be provided in alternate diameters.

Figure 2:
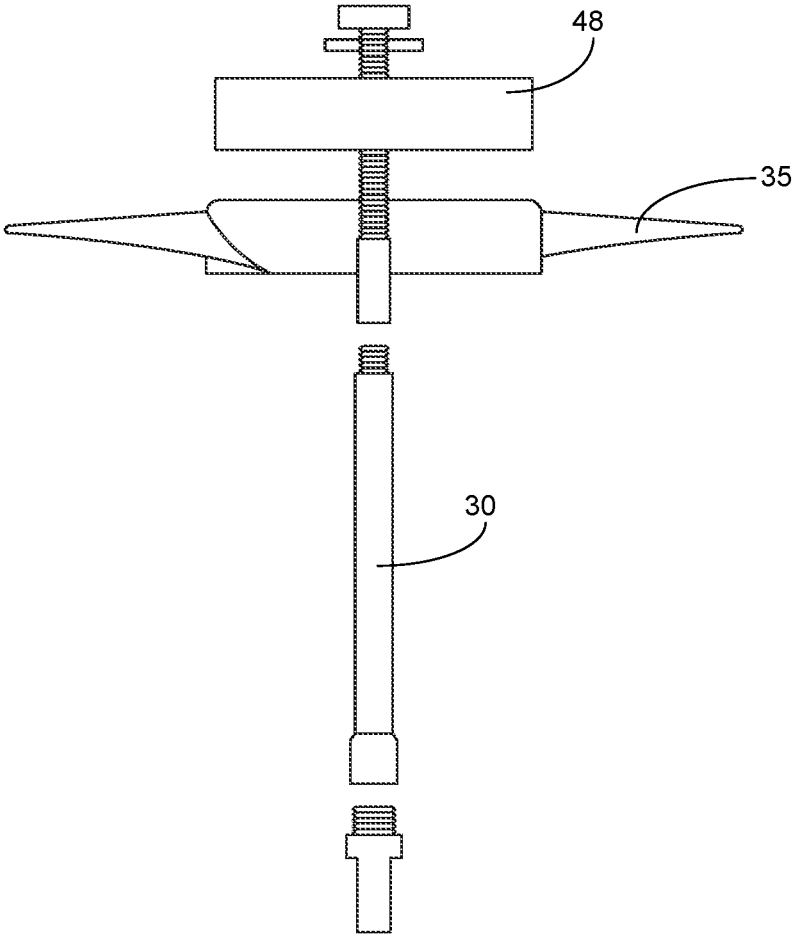
FIG. 2 is a diagrammatic view of a propeller and shaft of the present invention.
Figure 3:
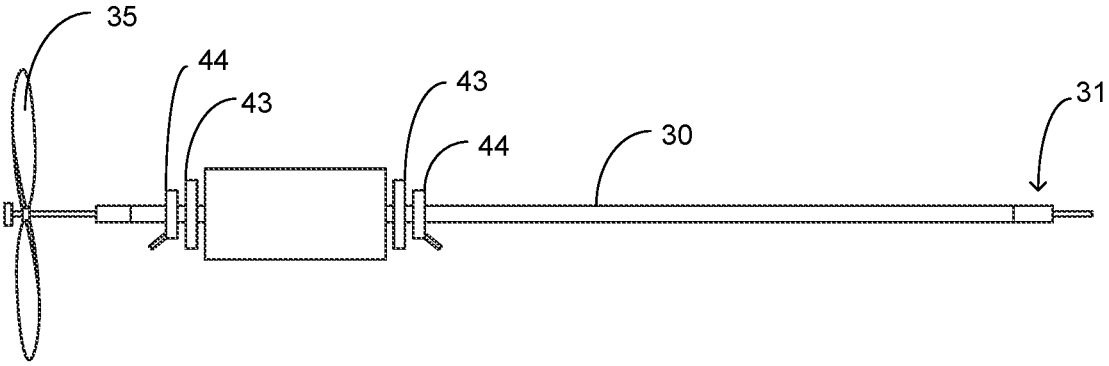
FIG. 3 is a side view of an embodiment of the propeller shaft assembly of the present invention.

A float member 40 can be secured to the shaft 30 as is illustrated herein in FIG. 3. The float member 40 is manufactured from a buoyant material and can function to inhibit the marine vessel propulsion apparatus 100 from sinking if dropped by a user or assist in desired positioning of the shaft assembly 25 during use of the marine vessel propulsion apparatus 100. The float member 40 is secured utilizing fasteners 43, 44 and it should be understood within the scope of the present invention that the fasteners 43, 44 could be numerous different types of mechanical fasteners. It should be understood within the scope of the present invention that the float member 40 could be provided in alternate sizes as well as be movable along the shaft 30 so as to place in alternate positions. FIG. 2 illustrates an alternate embodiment of a float member 48 wherein the float member 48 can be located on the opposing side of the propeller 35 from the shaft 30. It should be understood that either position of the float member 40 or float member 48 could be employed separately or in combination.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A marine vessel propulsion apparatus wherein the marine vessel propulsion apparatus comprises:

a motor assembly, said motor assembly having a housing, said housing of said motor assembly being waterproof, said motor assembly having an electric motor disposed within said housing, said motor assembly being configured to be handheld, and a shaft assembly, said shaft assembly including a shaft and a propeller, said shaft having a first end and a second end, said shaft being releasably secured to said motor assembly, said shaft operable to be rotatably moved in a first direction and a second direction, said propeller being secured to said second end of said shaft, and a float member, said float member being surroundably mounted to a portion of said shaft, said float member movably secured to said shaft so as to facilitate alternate positioning thereof.

2. The marine vessel propulsion apparatus as recited in claim 1, wherein said first direction of said shaft is clockwise.

3. The marine vessel propulsion apparatus as recited in claim 2, wherein said shaft is manufactured from a non-conductive material.

4. The marine vessel propulsion apparatus as recited in claim 3, wherein said second direction of said shaft is counterclockwise.

5. The marine vessel propulsion apparatus as recited in claim 4, wherein said float member is further configured to be placed in a second position, wherein in said second position said float member is intermediate said second end of said shaft and said propeller.

6. The marine vessel propulsion apparatus as recited in claim 5, wherein said shaft is three feet in length.

7. The marine vessel propulsion apparatus as recited in claim 6, wherein said shaft is manufactured from nylon.

8. The marine vessel propulsion apparatus as recited in claim 7, wherein said motor assembly further includes a power supply, said power supply being releasably secured to said motor assembly.

* * * * *